US006478160B1

(12) United States Patent
Au et al.

(10) Patent No.: US 6,478,160 B1
(45) Date of Patent: Nov. 12, 2002

(54) DISPLAYABLE JEWELRY CONTAINER

(75) Inventors: Ho Ching Au, Hong Kong (HK); Jian Qiang Siao, Dong Guan (CN)

(73) Assignee: Nationalpak Limited, Guang Dong (CN)

( * ) Notice: Subject to any disclaimer, the term of this patent is extended or adjusted under 35 U.S.C. 154(b) by 0 days.

(21) Appl. No.: 09/872,974

(22) Filed: May 31, 2001

(51) Int. Cl.[7] ..... B65D 43/14
(52) U.S. Cl. ..... 206/752; 206/6.1
(58) Field of Search ..... 206/751–755, 206/6.1, 301, 566, 738; 220/212, 522; 297/188.19

(56) References Cited

U.S. PATENT DOCUMENTS 1,817,766 A * 8/1931 Rhodes, Jr. ..... 206/752
1,957,157 A * 5/1934 Bosch ..... 206/752
2,118,507 A * 5/1938 Guttman ..... 206/752
2,979,223 A * 4/1961 Rideout ..... 220/212
3,613,873 A * 10/1971 Schulman ..... 206/752
4,034,849 A * 7/1977 Zakrajsek ..... 206/301
4,496,050 A * 1/1985 Kirchner et al. ..... 206/753
4,508,217 A * 4/1985 Long et al. ..... 206/753
4,889,257 A * 12/1989 Steffes ..... 220/212
5,562,331 A * 10/1996 Spykerman et al. ... 297/188.19
6,182,830 B1 * 2/2001 Au et al. ..... 206/6.1

* cited by examiner

*Primary Examiner*—Jim Foster
(74) *Attorney, Agent, or Firm*—Raymond Y. Chan; David and Raymond Patent Group

(57) ABSTRACT

A displayable jewelry container includes a box, a cover, and a display base affixed at a bottom surface of the cover. The box has a pair of integral guiding track groove provided on two inner surfaces of two parallel side panels of the box respectively. The cover has two pairs of guiding pegs protruded on two outer surfaces of two parallel cover side panels and slidably inserted into the pair of integral guiding track groove respectively so as to slidably support the cover on the box, wherein when the cover is arranged to cover the top opening of the box, the display base is disposed inside the box and covered by the cover, wherein to open the box for displaying the product, flip a front side of the cover over to up side down the cover until the display base is placed on top.

18 Claims, 6 Drawing Sheets

DISPLAYABLE JEWELRY CONTAINER

BACKGROUND OF THE PRESENT INVENTION

1. Field of Invention

The present invention relates to a jewelry container, and more particularly to a displayable jewelry container which is adapted for selectively packaging, storing and displaying ornamental objects such as watches, jewelries, glasses, cosmetics, etc.

2. Description of Related Arts

Traditionally, an ornamental object such as a watch or jewelry is held and display in a jewelry box for purposely showing the aesthetic characteristics of the ornamental object. The ornamental object is held in a groove or on a mount which is provided in an inner cavity of the jewelry box.

There are two types of the jewelry box for storage and display purposes respectively. First, the storage type jewelry box comprises a box body and a cover pivotally connected with the box body for jewelry customers to carry their purchased jewelry home and to store at home with protection. If the user wants to display the ornamental object inside the jewelry box, the cover must pivotally open from the box body. However, such jewelry box will waste lots of space storage especially when displaying.

The display type jewelry box generally includes the box body and the cover detachably attached to the box body for the jewelry shops to display the jewelry for sale during business hour. While the ornamental object is displayed, the cover is separated from the box body. It is inconvenient to place and is easy to lose the cover. Moreover, in order to prevent the cover from getting lost, most of the customers prefer the jewelry shops to give them the storage type jewelry box.

In other words, people always have conflict between packaging and displaying. Ignoring the right packaging may depreciate the value of the product. So, the jewelry box is important for the ornamental object since the jewelry box can not only store and display the ornamental object but also provide the best protection for the ornamental object.

SUMMARY OF THE PRESENT INVENTION

A main object of the present invention is to provide a displayable jewelry container which can be functioned as a storage type jewelry container as well as a display type jewelry container, which comprises a box and a cover which is slidably connected to the box wherein an ornamental object is held on the cover for storage and display in such a manner that when box is closed by the cover, the ornamental object is disposed in and well protected by the jewelry box, and when the cover is flipped up side down, the ornamental object is exposed to outside for displaying.

Another object of the present invention is to provide a displayable jewelry container wherein the cover comprises two pairs of guiding pegs opposedly formed on two outer surfaces of two cover side panels respectively for slidably inserting into two sliding tracks on two inner surfaces of two box side panels, so as to enhance the sliding movement of the cover with respect to the box.

Another object of the present invention is to provide a displayable jewelry container wherein the two pairs of guiding pegs are adapted for rigidly supporting the cover on the box so as to prevent the cover being taken away from the box accidentally.

Another object of the present invention is to provide a displayable jewelry container wherein the sliding movement of the cover with the box is easy and fast, that every individual is able to flip the cover in one single motion for storing and displaying the ornamental object.

Accordingly, in order to accomplish the above objects, the present invention is to provide a displayable jewelry container, comprising:

a box having a top opening and defining a receiving cavity therein, a pair of elongated slider tracks horizontally indented on two inner surfaces of two parallel side panels of the box respectively, and a pair of elongated auxiliary turn-over tracks integrally extended from the slider tracks respectively, wherein each of the slider tracks having a front blocked end positioned at a front end of the side panel and a rear blocked end positioned at a rear end of the side panel, wherein each of the auxiliary turn-over tracks has a rear stopper end positioned behind the rear blocked end of the slider track;

a cover having two pairs of guiding pegs formed on two outer surfaces of two parallel cover side panels respectively, each of the pair of pegs being outwardly and perpendicularly protruded from an upper portion of a rear end of the respective cover side panel, a distance between the two outer surfaces of the two cover side panels of the cover being slightly smaller than a distance between the two inner surfaces of the two side panels of the box, wherein the two cover side panels of the cover are placed between and adjacent to the two side panels of the box while the four pegs provided on the two outer surfaces of the two cover side panels of the cover are slidably inserted into the two slider tracks provided on the two inner surfaces of the two side panels of the box respectively, wherein the four pegs are stopped and positioned at the two rear blocked ends of the two slider tracks and the two rear stopper ends of the two auxiliary turn-over tracks respectively while the cover is arranged to cover the top opening of the box; and a display base, which is affixed at a bottom surface of the cover for mounting a product to be stored and displayed in such a manner that when the cover is arranged to cover the top opening of the box, the display base is disposed inside the box and covered by the cover, wherein to open the box for displaying the product, flip a front side of the cover over to up side down the cover until the display base is placed on top and then slide the cover frontwardly until the pegs of the cover are slid to position at the two front blocked ends of the two side panels of the box and the cover is rest on the box.

DETAILED DESCRIPTION OF THE PREFERRED EMBODIMENT

Figure 1:
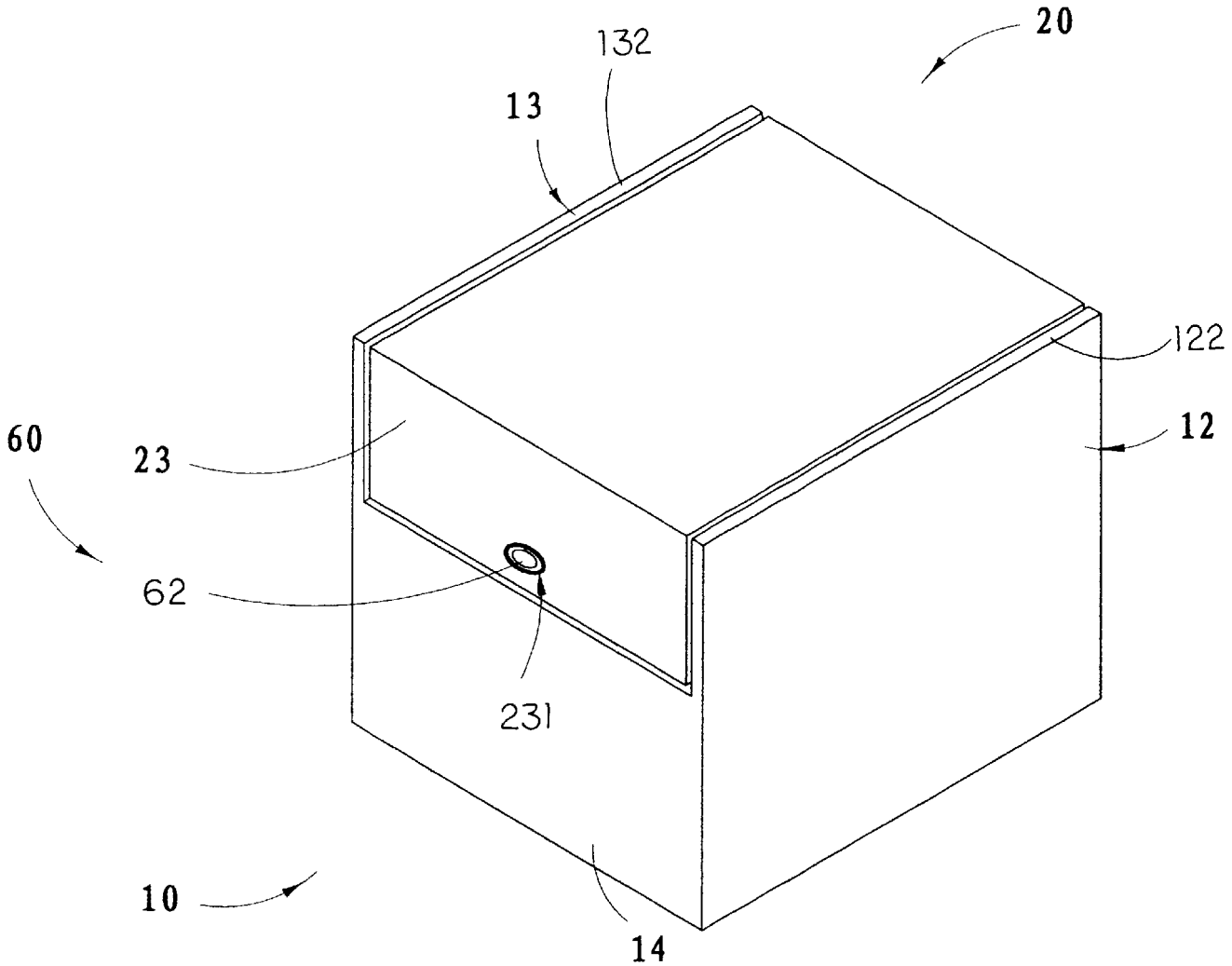
FIG. 1 is a perspective view of a displayable jewelry container according to a preferred embodiment of the present invention.
Figure 2:
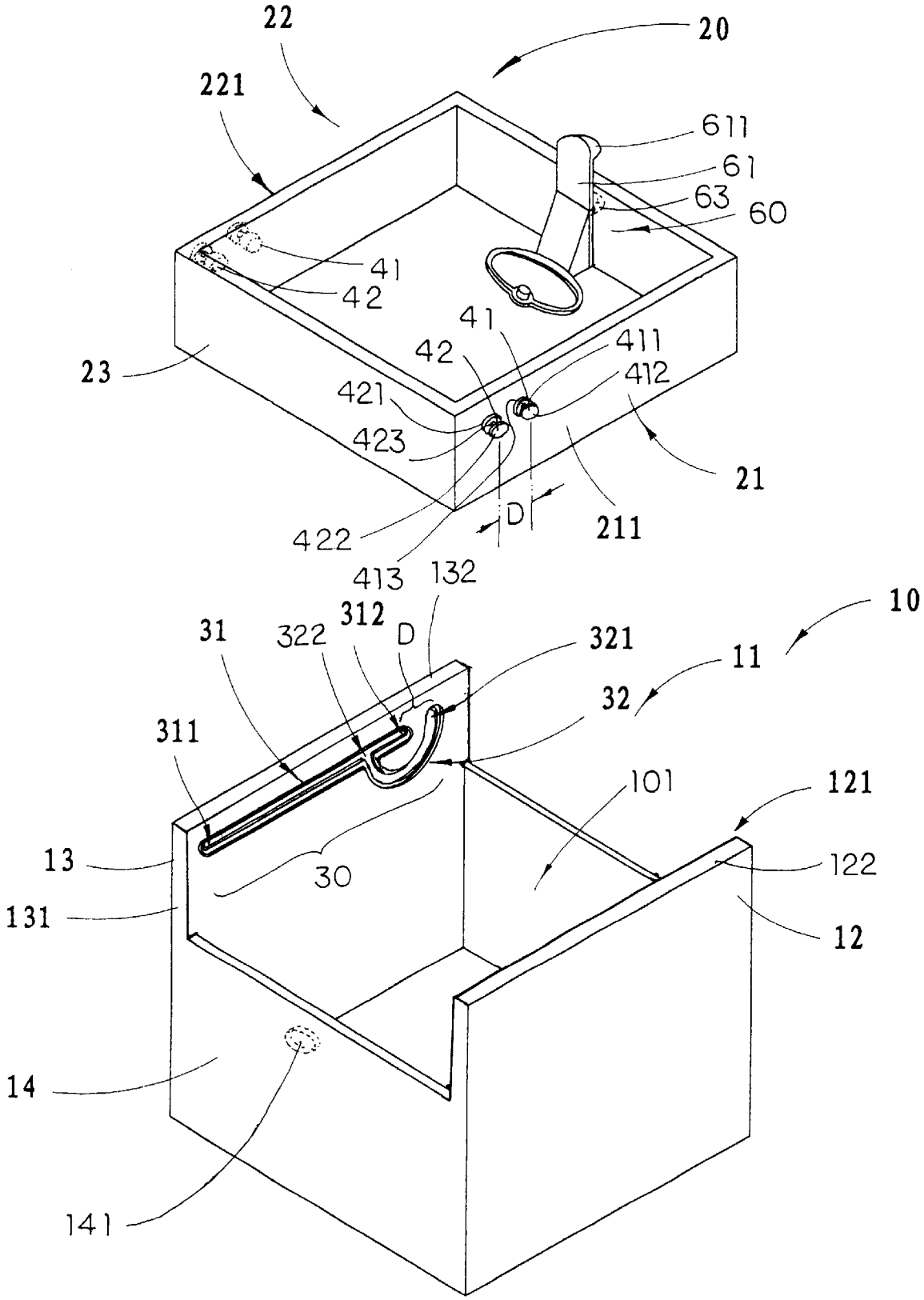
FIG. 2 is an exploded perspective view of the displayable jewelry container according to the above preferred embodiment of the present invention.

Referring to FIGS. 1 and 2 of the drawings, a displayable jewelry container according to a preferred embodiment of the present invention is illustrated wherein the displayable jewelry container is capable of storing and displaying a product or an ornamental object such as watch or jewelry. Thus, the displayable jewelry container can be functioned as a storage type jewelry container as well as a display type jewelry container, so that the product or the ornamental object such as watch or jewelry is well protected while enhancing the aesthetic appearance of the product.

The displayable jewelry container comprises a box 10 and a cover 20 slidably connected to the box 10. The box 10 has a top opening 11 and defines a receiving cavity therein 101.

The box 10 has a pair of elongated slider tracks 31, which are indented on upper portions of two inner surfaces 121, 131 of two parallel side panels 12, 13 of the box 10 and transversally extended along two top edges 122, 132 of the two inner surfaces 121, 131 of the two parallel side panels 12, 13 respectively, and a pair of elongated auxiliary turn-over tracks 32 indented on the two inner surfaces 121, 131 of the two parallel side panels 12, 13 of the box 10 and extended from the two elongated slider tracks 31 respectively.

As shown in FIGS. 2, 3A to 3D, each of the elongated slider tracks 31 is an elongated straight groove having a front blocked end 311 positioned at a front end of the side panel 12, 13 of the box 10 and a rear blocked end 312 positioned at a rear end of the side panel 12, 13 of the box 10. Each of the auxiliary turn-over tracks 32, which is a semi-circular C-shaped groove, has a rear stopper end 321 positioned right behind the rear blocked end 312 of the slider track 31 to define a pivot distance D between the rear blocked end 312 and the rear stopper end 321, wherein a front stopper end 322 joins a rear portion of the respective elongated slider track 31 to form an integral guiding track groove 30. In which, the rear blocked end is positioned at a center position between the front stopper end and the rear stopper end.

Figure 4:
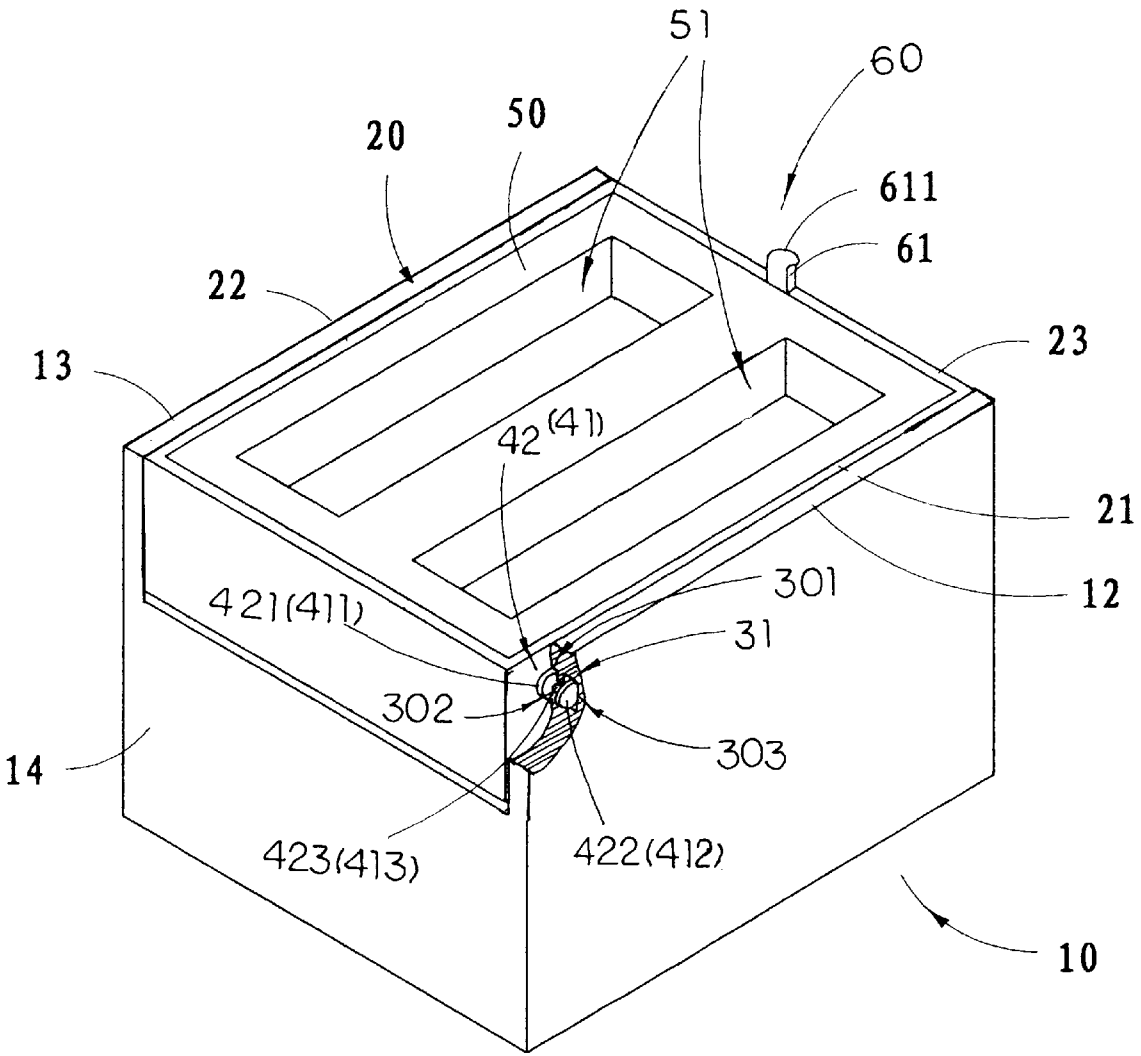
FIG. 4 is a partially sectional perspective view of the displayable jewelry container in an open position according to the above preferred embodiment of the present invention.

As shown in FIG. 4, according to the preferred embodiment of the present invention, the integral guiding track groove 30 which has in I-shaped cross section has an outer groove 301, an inner groove, 302 and a narrowed intermediate neck groove 303.

The cover 20 has two pairs of guiding pegs 41, 42 respectively projected on two outer surfaces 211, 221 of two parallel cover side panels 21, 22 of the cover 20, wherein the two guiding pegs 41, 42 of each pair of the guiding pegs are separated apart for a distance equal to the pivot distance D of the integral guiding track groove 30. Each of the guiding pegs 41, 42 has a I-shaped cross section that comprises a round mounting head 411, 421 plugged into the outer surface 211, 221 of the respective cover side panel 21, 22, a round guiding disc 412, 422 outwardly and perpendicularly protruded, from the outer surface 211, 221 of the respective cover side panel 21, 22, and a neck 413, 423 having a diameter smaller than the guiding disc 412, 422 and integrally connecting between the mounting head 411, 421 and the guiding disc 412, 422.

A distance between the two outer surfaces 211, 221 of the two cover side panels 21, 22 of the cover 20 is preferred to be slightly smaller than a distance between the two inner surfaces 121, 131 of the two side panels 12, 13 of the box 10. Referring to FIGS. 1, 2 and 4, the two cover side panels 21, 22 of the cover 20 are placed between and adjacent to the two side panels 12, 13 of the box 10 while the two pairs of guiding pegs 40 provided on the two outer surfaces 211, 221 of the two cover side panels 21, 22 of the cover 20 are slidably inserted into the two slider tracks 30 provided on the two inner surfaces 121, 131 of the two side panels 12, 13 of the box 10 respectively.

As shown in FIGS. 2 and 4, each of the guiding pegs 41, 42 are coupled with the respective guiding track groove 30, i.e. the elongated slider track 31 and the auxiliary turn-over track 32, in such a manner that the mounting head 411, 421 is slidably supported at the outer groove 301, the neck 413, 423 is slidably engaged at the neck groove 303, and the guiding disc 412, 422 is slidably positioned in the inner groove 302, so that the cover 20 is slidably mounted on top of the box 10 adapted for covering the top opening 11 of the box 10.

As shown in FIG. 4, the displayable jewelry container further comprises a display base 50, which is affixed at a bottom surface of the cover 10 for mounting a product to be stored and displayed.

As shown in FIGS. 1 and 3A–3D, when the cover 20 covers the top opening 11 of the box, the two pairs of guiding pegs 41, 42 are arranged to position at the two rear blocked ends 312 of the two slider tracks 31 and the two rear stopper ends 321 of the two auxiliary turn-over tracks 32 respectively, the display base 50 is inwardly placed inside the receiving cavity 101 of the box 10 and covered by the cover 20 for protection during storage and transportation.

Figure 3A:
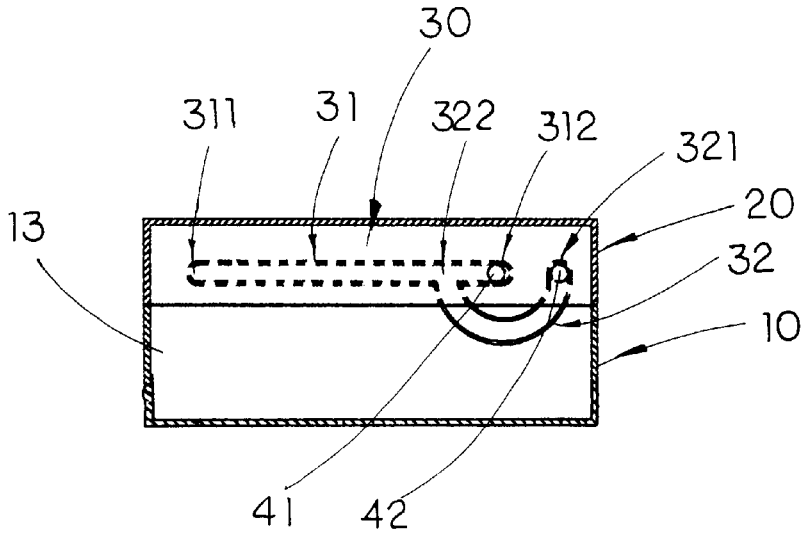
FIGS. 3A to 3D are sectional views of the displayable jewelry container according to the above preferred embodiment of the present invention.
Figure 3B:
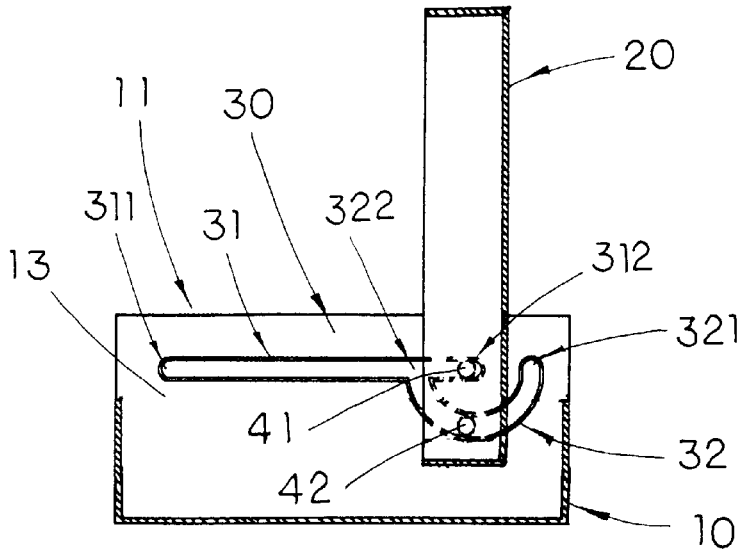
Figure 3C:
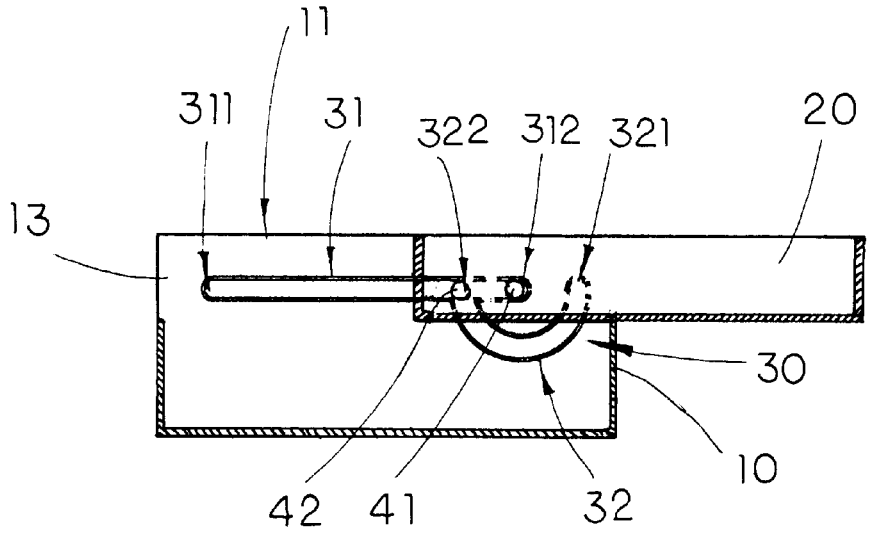
Figure 3D:
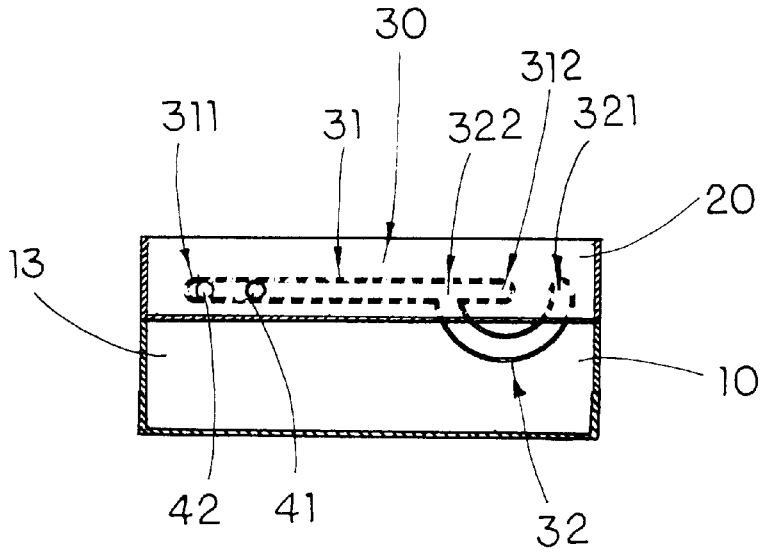

As shown in FIGS. 3B and 3C, the two front guiding pegs 41 form a turning axle of the cover 20 when opening the cover 20. Simply by lifting up the front end of the cover 20, the cover 20 can be turned over by traveling the two back guiding pegs 42 from the rear stopper ends 321 to the front stopper ends 322 of the two auxiliary turn-over tracks 32 respectively until the cover 20 is positioned upside down. Then, the cover 20 can be slid frontwardly, as shown in FIG. 3D, by traveling the two pairs of guiding pegs 41, 42 along the two elongated slider tracks 31 respectively, i.e. from the two rear blocked ends 312 to the two front blocked ends 311, until the cover 20 is overlappingly rested on the box 10 in an upside down manner so as to open the cover 20 and retains the cover 20 in an opened condition, as shown in FIGS. 3D and 4. Therefore, the user may use the same jewelry container of the present invention to display the jewelry product received therein for business.

After business hour, the merchants can simply close up the same displayable jewelry container through the following steps for storage and protection.

(a) Slide the cover 20 rearwardly by traveling the two pairs of guiding pegs 41, 42 along the two elongated slider tracks 31 respectively, i.e. from the two front blocked ends 311 to the two rear blocked ends 312, as shown in FIG. 3C.

(b) Lift up the rear end of the cover 20, as shown in FIGS. 3B and 3C, wherein the two front guiding pegs 41 form the turning axle of the cover 20 and the two back guiding pegs 42 travel from the two front stopper ends 322 to the two rear stopper ends 321 of the two auxiliary turn-over tracks 32 respectively until the cover 20 is turned over to cover the box and dispose the display base 50 inside the receiving cavity 101 of the box 10 again, as shown in FIG. 3A.

Accordingly, when the jewelry received in the displayable jewelry container of the present invention is sold, the merchant can simply give the same displayable jewelry container to the customer. We don't need to repack the jewelry in a storage jewelry box again. Besides, most customers will like to have the displayable jewelry container of the present invention rather than the conventional storage box. It is because most the jewelry boxes look like the same, so that the users have to open every box to check the jewelry therein while choosing the right jewelry to wear. For the customers of the present invention, they can simply put their jewelry goods in the save with the same displayable jewelry container in such opened condition so as to facilitate them to choose the preferred jewelry to wear.

Alternatively, each rear blocked end 312 of the slider track 31 can be perpendicularly and upwardly extended therefrom so that the cover 20 is capable of slightly sliding upward when the respective peg 40 is located at the rear blocked end 312 of the slider track 31, so as to easily flip the cover 20 up side down, The displayable jewelry container further comprises a locking means 60 for securely locking the cover 20 with the box 10, wherein the locking means 60 comprises a locking latch 61 having a tip 611 at one end and an operation button 62 at another end. The locking latch 61 is downwardly extended from a cover front panel 23 of the cover 20 for engaging with a locking slot 141 indented on an inner surface of a front panel 14 of the box 10 so as to lock the cover 20 with the box. The operation button 62 is slidably protruded out of the cover front panel 23 through an operation hole 231 provided thereon. Press down the operation button 62 can drive the locking latch 61 from a locking position to an unlocked position. In the locking position, the tip 611 of the locking latch 61 is engaged with the locking slot 141 of the cover 20 so as to lock up the cover 20 with the box 10. In the unlocked position, the tip 611 of the locking latch 61 is driven to move away from the locking slot 141 by pressing down the operation button 63 so that the cover 20 is adapted for slidably moving with respect to the box 10.

The displayable jewelry container is adapted for storing and displaying the product. In the storage position, as shown in FIG. 1, the cover 10 is arranged to cover the top opening 11 of the box 10 wherein the display base 50 is disposed inside the box 10 and covered by the cover 20 in such a manner the product is well protected by the displayable jewelry container.

To display the product, as shown in FIG. 4, the front side of the cover 20 is flipped over until the display base 50 is placed on top wherein the two pegs 40 positioned at the rear stopper ends 321 of the auxiliary turn-over tracks 32 are slid along the auxiliary turn-over tracks 32 toward the slider tracks 31. When the cover 20 is flipped up side down, the two pairs of guiding pegs 41, 42 are positioned along the elongated slider tracks 31 in such a manner that the cover 20 is adapted for slidably moving frontward until the guiding pegs 41, 42 are stopped and blocked by the front blocked ends 311 of the slider tracks 31. So, the display base 50 is positioned on top of the box 10 and the product held on the display base 50 can be shown its aesthetic appearance.

Accordingly, the display base 50 has at least a mounting slot 51 for mounting a ring shape product, such as a watch, thereon wherein a ring-shaped supporting frame is adapted for rigidly supporting the product and fittedly receiving in the mounting slot 51, as shown in FIG. 4.

Figure 5:
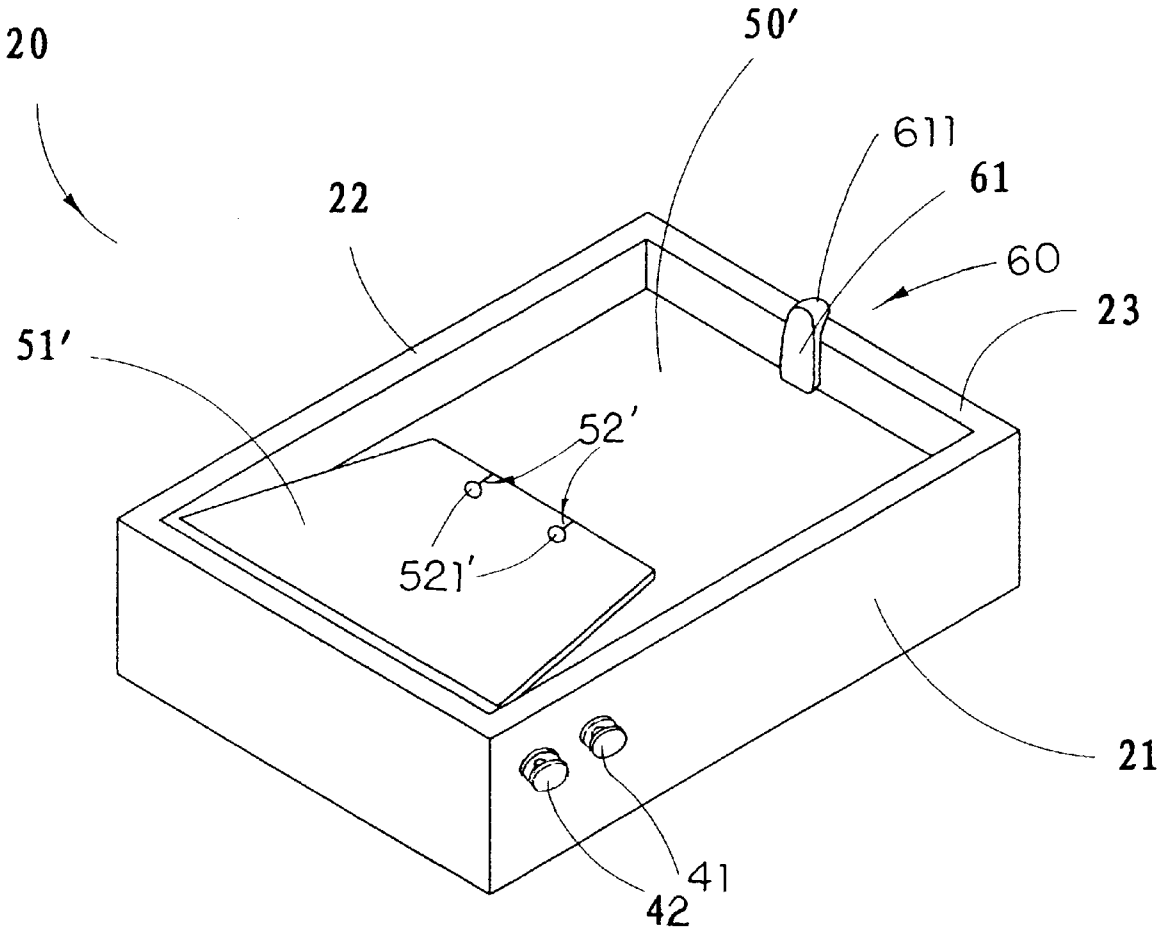
FIG. 5 is a perspective view illustrating an alternative mode of the displayable jewelry container according to the above preferred embodiment of the present invention.

FIG. 5 illustrates an alternative mode of the display base 50' of the displayable jewelry container wherein the display base 50' comprises a display lip 51' upwardly extended therefrom wherein the display lip 51' has a pair of mounting slits 52' each having an enlarged tail portion 521' spacedly formed on the display lip 51' for securely holding a chain like product such as a neck-let on the display base 50'.

It is worth to mention that the cover 20 is well supported on the box 10 by the two pairs of guiding pegs 41, 42 which are slidably inserted into the slider tracks 31 and the auxiliary turnover tracks 32 respectively. In the sliding movement of the cover 20, the cover 20 is reinforced by the two pairs of guiding pegs 41, 42 so as to prevent a lateral movement of the cover 20. Thus, in the display position of the displayable jewelry container, the two pairs of guiding pegs 41, 42 are positioned on the elongated slider tracks 31 to lock up the rotating movement of the cover 20 such that the cover 20 cannot be flipped over accidentally, so as to prevent the product from dropping out of the displayable jewelry container accidentally.

What is claimed is:

1. A displayable jewelry container, comprising:

a box having a top opening and defining a receiving cavity therein, wherein a pair of elongated slider tracks are parallelly provided on two inner surfaces of two side panels of said box respectively and a pair of elongated auxiliary turn-over tracks are provided on said two inner surfaces of said two side panels of said box and integrally extended from said two elongated slider tracks respectively, wherein each of said elongated slider tracks has an elongated straight groove having a front blocked end and a rear blocked end and each of said auxiliary turn-over tracks is a semi-circular C-shaped groove having a rear stopper end positioned behind said rear blocked end of said slider track, wherein said rear blocked end is positioned at a center position between said front stopper end and said rear stopper end and defines a pivot distance between said rear blocked end and said rear stopper end, wherein a front stopper end joins a rear portion of said respective elongated slider track to form an integral guiding track groove;

a cover having a front pair and back pair of guiding pegs respectively projected on two outer surfaces of two cover side panels of said cover wherein said two guiding pegs of each pair of said guiding pegs are separated apart for a distance equal to said pivot distance of said integral guiding track groove, wherein said cover is supported between said two side panels of said box, while said two cover side panels of said cover are placed between and adjacent to said two side panels of said box, by slidably inserting said front and back pairs of guiding pegs of said two cover side panels of said cover said two integral guiding track grooves respectively; and a display base, which is affixed at a bottom surface of said cover for mounting an article to be stored and displayed;

whereby when said cover covers said top opening of said box, said front and back pairs of guiding pegs are arranged to position at said two rear blocked ends of said two slider tracks and said two rear stopper ends of said two auxiliary turn-over tracks respectively, therefore said two front guiding pegs form a turning axle of said cover when opening said cover, wherein by lifting up said front end of said cover, said cover is turned over by traveling said back pair guiding pegs from said rear stopper ends to said front stopper ends of said two auxiliary turn-over tracks respectively until said cover is positioned upside down, so that said cover is capable of sliding frontwardly by traveling said front and back pairs of guiding pegs along said two elongated slider tracks respectively, traveling from said two rear blocked ends to said two front blocked ends, until said cover is overlappingly rested on said box in an upside down manner so as to open said cover and retains said cover in an opened condition.

2. A displayable jewelry container, as recited in claim 1, wherein said pair of elongated slider tracks are indented on upper portions of said two inner surfaces of said two parallel side panels of said box and transversally extended along two top edges of said two inner surfaces of said two parallel side panels respectively, and said pair of elongated auxiliary turn-over tracks are indented on said two inner surfaces of said two parallel side panels of said box respectively.

3. A displayable jewelry container, as recited in claim 1, wherein each of said integral guiding track grooves has an outer groove, an inner groove, and a narrowed intermediate neck groove to form an I-shaped cross section.

4. A displayable jewelry container, as recited in claim 2, wherein each of said integral guiding track grooves has an outer groove, an inner groove, and a narrowed intermediate neck groove to form an I-shaped cross section.

5. A displayable jewelry container, as recited in claim 3, wherein each of said guiding pegs has a I-shaped cross section that comprises a round mounting head plugged into said outer surface of said respective cover side panel, a round guiding disc outwardly and perpendicularly protruded from said outer surface of said respective cover side panel, and a neck having a diameter smaller than said guiding disc and integrally connecting between said mounting head and said guiding disc.

6. A displayable jewelry container, as recited in claim 4, wherein each of said guiding pegs has a I-shaped cross section that comprises a round mounting head plugged into said outer surface of said respective cover side panel, a round guiding disc outwardly and perpendicularly protruded from said outer surface of said respective cover side panel, and a neck having a diameter smaller than said guiding disc and integrally connecting between said mounting head and said guiding disc.

7. A displayable jewelry container, as recited in claim 5, wherein a distance between said two outer surfaces of said two cover side panels of said cover is slightly smaller than a distance between said two inner surfaces of said two side panels of said box, wherein said two cover side panels of said cover are placed between and adjacent to said two side panels of said box while said two pairs of guiding pegs provided on said two outer surfaces of said two cover side panels of said cover are slidably inserted into said two slider tracks provided on said two inner surfaces of said two side panels of said box respectively, wherein each of said guiding pegs are coupled with said respective guiding track groove in such a manner that said mounting head is slidably supported at said outer groove, said neck is slidably engaged at said neck groove, and said guiding disc is slidably positioned in said inner groove, so that said cover is slidably mounted on top of said box adapted for covering said top opening of said box.

8. A displayable jewelry container, as recited in claim 6, wherein a distance between said two outer surfaces of said two cover side panels of said cover is slightly smaller than a distance between said two inner surfaces of said two side panels of said box, wherein said two cover side panels of said cover are placed between and adjacent to said two side panels of said box while said two pairs of guiding pegs provided on said two outer surfaces of said two cover side panels of said cover are slidably inserted into said two slider tracks provided on said two inner surfaces of said two side panels of said box respectively, wherein each of said guiding pegs are coupled with said respective guiding track groove in such a manner that said mounting head is slidably supported at said outer groove, said neck is slidably engaged at said neck groove, and said guiding disc is slidably positioned in said inner groove, so that said cover is slidably mounted on top of said box adapted for covering said top opening of said box.

9. A displayable jewelry container, as recited in claim 1, further comprising a locking means for securely locking said cover with said box.

10. A displayable jewelry container, as recited in claim 5, further comprising a locking means for securely locking said cover with said box.

11. A displayable jewelry container, as recited in claim 6, further comprising a locking means for securely locking said cover with said box.

12. A displayable jewelry container, as recited in claim 7, further comprising a locking means for securely locking said cover with said box.

13. A displayable jewelry container, as recited in claim 8, further comprising a locking means for securely locking said cover with said box.

14. A displayable jewelry container, as recited in claim 9, wherein said locking means comprises a locking latch having a tip at one end and an operation button at another end, wherein said locking latch is downwardly extended from a cover front panel of said cover for engaging with a locking slot indented on an inner surface of a front panel of said box so as to lock said cover with said box, wherein said operation button is slidably protruded out of said cover front panel through an operation hole provided thereon.

15. A displayable jewelry container, as recited in claim 10, wherein said locking means comprises a locking latch having a tip at one end and an operation button at another end, wherein said locking latch is downwardly extended from a cover front panel of said cover for engaging with a locking slot indented on an inner surface of a front panel of said box so as to lock said cover with said box, wherein said operation button is slidably protruded out of said cover front panel through an operation hole provided thereon.

16. A displayable jewelry container, as recited in claim 11, wherein said locking means comprises a locking latch having a tip at one end and an operation button at another end, wherein said locking latch is downwardly extended from a cover front panel of said cover for engaging with a locking slot indented on an inner surface of a front panel of said box so as to lock said cover with said box, wherein said operation button is slidably protruded out of said cover front panel through an operation hole provided thereon.

17. A displayable jewelry container, as recited in claim 12, wherein said locking means comprises a locking latch having a tip at one end and an operation button at another end, wherein said locking latch is downwardly extended from a cover front panel of said cover for engaging with a locking slot indented on an inner surface of a front panel of said box so as to lock said cover with said box, wherein said operation button is slidably protruded out of said cover front panel through an operation hole provided thereon.

18. A displayable jewelry container, as recited in claim 13, wherein said locking means comprises a locking latch having a tip at one end and an operation button at another end, wherein said locking latch is downwardly extended from a cover front panel of said cover for engaging with a locking slot indented on an inner surface of a front panel of said box so as to lock said cover with said box, wherein said operation button is slidably protruded out of said cover front panel through an operation hole provided thereon.

* * * * *